US005893809A

United States Patent [19]

Coats et al.

[11] Patent Number: 5,893,809

[45] Date of Patent: Apr. 13, 1999

[54] BASKETBALL GOAL

[75] Inventors: Mark S. Coats, Shaker Heights; Peter C. McEachen, Cleveland Heights; Michael Miroewski, Seven Hills, all of Ohio

[73] Assignee: The Little Tikes Company, Hudson, Ohio

[21] Appl. No.: 09/020,176

[22] Filed: Feb. 6, 1998

[51] Int. Cl.[6] ..... A63B 63/08

[52] U.S. Cl. ..... 473/479; 473/486

[58] Field of Search ..... 473/447, 472, 473/479, 480, 481, 483, 485, 486, 488

[56] References Cited

U.S. PATENT DOCUMENTS

| | | | |
|---|---|---|---|
| D. 315,185 | 3/1991 | Maloney | D21/200 |
| D. 320,637 | 10/1991 | Fish, Jr. et al. | D21/201 |
| 3,716,234 | 2/1973 | Lancellotti | 273/1.5 R |
| 4,145,044 | 3/1979 | Wilson et al. | 273/1.5 R |
| 4,793,611 | 12/1988 | Thornell | 273/1.5 R |
| 5,082,261 | 1/1992 | Pelfrey | 273/1.5 R |
| 5,248,140 | 9/1993 | Matherne et al. | 273/15 R |
| 5,259,612 | 11/1993 | Matherne et al. | 273/1.5 R |
| 5,300,920 | 4/1994 | Caselli et al. | 340/323 R |
| 5,354,049 | 10/1994 | Matherne et al. | 273/1.5 R |
| 5,375,835 | 12/1994 | Van Nimwegen et al. | 273/1.5 R |
| 5,377,976 | 1/1995 | Matherne et al. | 273/1.5 R |
| 5,390,914 | 2/1995 | Schroeder | 473/483 |
| 5,393,048 | 2/1995 | Rodriguez-Ferre | 473/483 |
| 5,524,883 | 6/1996 | Allen et al. | 273/1.5 R |
| 5,556,088 | 9/1996 | Mower et al. | 273/1.5 R |
| 5,573,237 | 11/1996 | Van Nimwegen et al. | 273/1.5 R |
| 5,672,130 | 9/1997 | O'Connell et al. | 473/483 |
| 5,730,668 | 3/1998 | Hege et al. | 473/472 |

OTHER PUBLICATIONS

Fisher Price Instructions "Grow To Pro™ Basketball", pp. 1–6, (1996).

Lifetime Instructions "Stow Away™ Basketball System", 2 pages, (Jul. 11, 1997).

The Ohio Art Company Instructions "hill Basketball", 2 pages, (Nov. 26, 1996).

*Primary Examiner*—William H. Grieb

*Attorney, Agent, or Firm*—Renner, Kenner, Greive, Bobak, Taylor & Weber

[57] ABSTRACT

A basketball goal assembly (10) includes a base (11), a pole assembly (12) carried by the base (11), a rim assembly (14) pivotally carried by the pole assembly (12) and a backboard (13) carried by the pole assembly (12). The pole assembly (12) has a front face (21) having a recess (27) therein. A lug (36) on the rim assembly (14) is received in the recess (27) to hold the rim assembly (14) in a useable condition. Upon a downward force on the rim assembly (14), the rim assembly (14) breaks away from the pole assembly (12) as the lug (36) comes out of the recess (27). A yoke (59) extends between the base (11) and the pole assembly (12) to assist in supporting the pole assembly (12). However, the yoke (59) may be removed from the pole assembly (12) and the base (11) and positioned in a compartment (64) formed in the base (11). The pole assembly (12) may then be rotated to be generally flat with the base (11) and to be positioned over the yoke (59). A scoring system (44) may also be provided on the pole assembly (12).

30 Claims, 9 Drawing Sheets

BASKETBALL GOAL

TECHNICAL FIELD

This invention relates to a basketball goal which is particularly suited as a toy basketball goal for young children. More specifically, this invention relates to such a goal which has a breakaway rim so that the goal will not fall on the child upon a downward force being applied to the rim.

BACKGROUND ART

Basketball goals which are particularly suited for use by young children are known in the art. Typically, such goals include a base to which a pole is attached and then a backboard and rim assembly is attached to the top of the pole. Many such devices require a plurality of fasteners for assembly purposes and do not, therefore, provide for quick and easy assembling. Moreover, most of these devices do not provide for compact storing during periods of nonuse.

Some of the prior art devices, such as those shown in U.S. Pat. Nos. 4,793,611 and 5,082,261, provide for a height adjustment of the pole so that as the child grows in height or in skill, the rim may be raised to provide more of a challenge. However, in these devices, if the child is able to reach and grasp the rim, it is entirely possible that the entire assembly will tip and possibly fall onto the child.

In an attempt to solve this potential safety problem, a rim as been designed which fits over or otherwise straddles the pole. The design is such that upon a downward force on the outer end of the rim, the connection between the rim and the back of the pole will break allowing the rim to pivot slightly downwardly. However, because the inner end of the rim is still straddling the pole, the potential to pull the pole forwardly to tip the assembly still exists.

Moreover, a breakaway rim not only provides a safety feature to the product but also provides the child with a more realistic toy because most adult basketball rims are provided with a breakaway backboard.

Thus, the need exists for a basketball goal with a rim which will break away from the backboard in such a manner so as to reduce the possibility of the unit tipping and falling to the ground and to provide a more realistic children's toy.

DISCLOSURE OF THE INVENTION

It is thus an object of the present invention to provide a basketball goal which is safe to use.

It is another object of the present invention to provide a basketball goal, as above, which is particularly suited for young children.

It is a further object of the present invention to provide a basketball goal, as above, which is realistic and safer, having a rim which will break away from its supporting pole upon the application of a downward force thereto.

It is an additional object of the present invention to provide a basketball goal, as above, which can be folded into a flat condition for ease of storage or shipping.

It is yet another object of the present invention to provide a basketball goal, as above, in which the pole is provided with a feature enabling the user to keep the score of a game being played.

It is a still further object of the present invention to provide a basketball goal, as above, which is height adjustable, portable, and easy to assemble with a minimal amount of fasteners.

These and other objects of the present invention, as well as the advantages thereof over existing prior art forms, which will become apparent from the description to follow, are accomplished by the improvements hereinafter described and claimed.

In general, a basketball goal made in accordance with the present invention includes a base and a pole assembly carried by the base. A rim assembly is pivotally carried by the pole assembly, and a backboard is also carried by the pole assembly. The pole assembly has a front face which has a recess therein. The rim assembly includes a lug which is receivable in the recess such that when the lug is in the recess, the rim assembly is held in a useable condition, but when a downward force is applied to the rim assembly, the lug is released from the recess.

In accordance with another aspect of the present invention, a yoke is provided between the base and the pole assembly. The base has a compartment therein which may receive the yoke. The pole assembly is pivotable to a position over the yoke when the yoke is in the compartment.

A preferred exemplary basketball goal incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
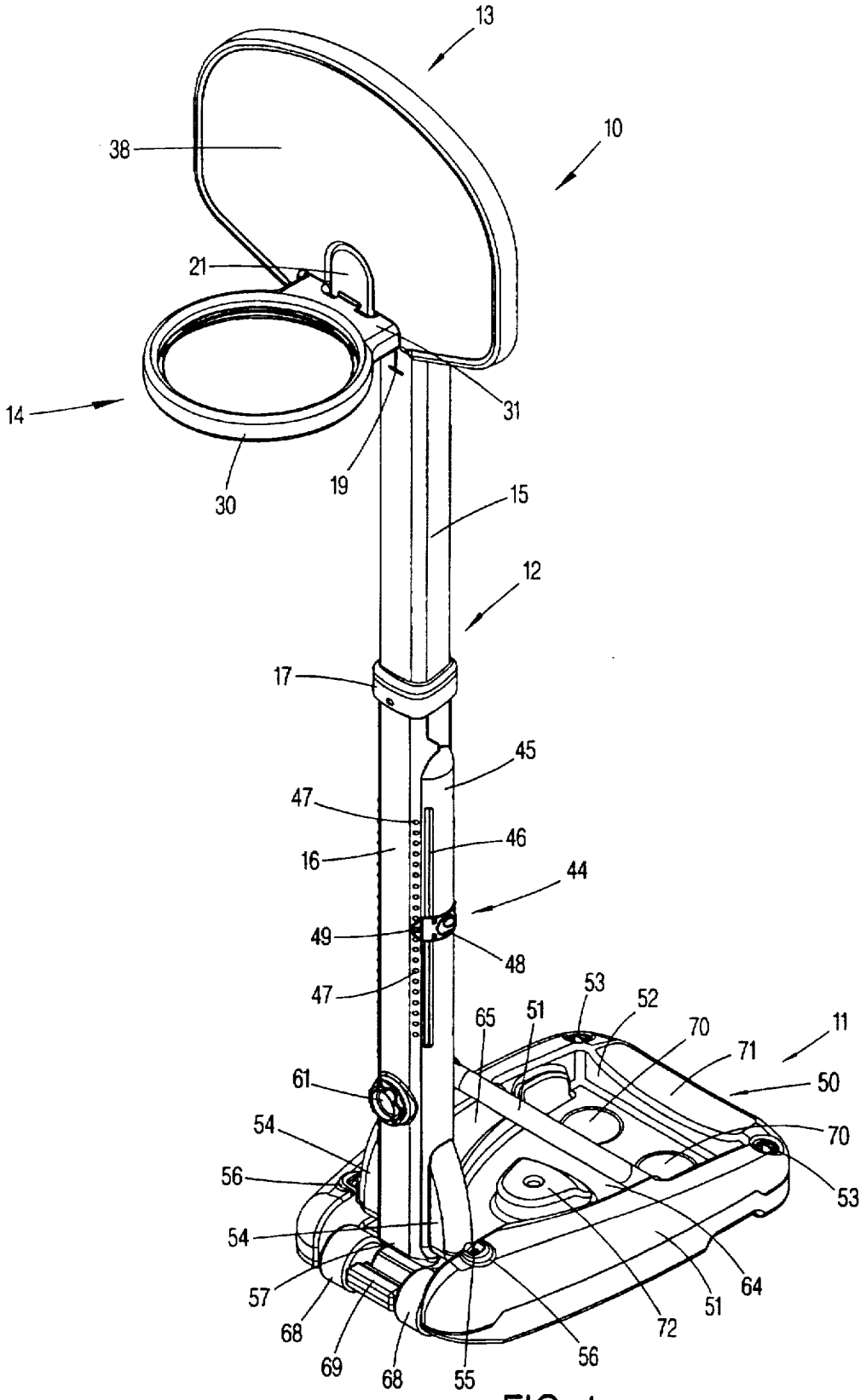
FIG. 1 is front perspective view of a basketball goal made in accordance with the concepts of the present invention.

A basketball goal assembly made in accordance with the concepts of the present invention is indicated generally by the numeral 10 and includes, as its primary components, a base pedestal generally indicated by the numeral 11, a pole assembly generally indicated by the numeral 12, a backboard generally indicated by the numeral 13, and a rim assembly generally indicated by the numeral 14. All of these components may be molded from a suitable plastic material such as high density polyethylene.

Pole assembly 12 includes an upper pole 15 which is telescopically received within a lower pole 16. As such, the height of goal assembly 10 may be adjusted by means of a latch assembly 17 which holds pole 15 relative to pole 16 at selected positions defined by detents 18 positioned on one side of pole 15. A stop lug 19 is provided on the front and back of upper pole 15. These lugs can abut against the top of lower pole 16 to thereby define the lowest position of upper pole 15. The details regarding this adjustment feature are fully described in U.S. Pat. No. 5,082,261 to which reference is made for whatever details are necessary to understand the height adjustment feature of goal assembly 10.

Figure 3:
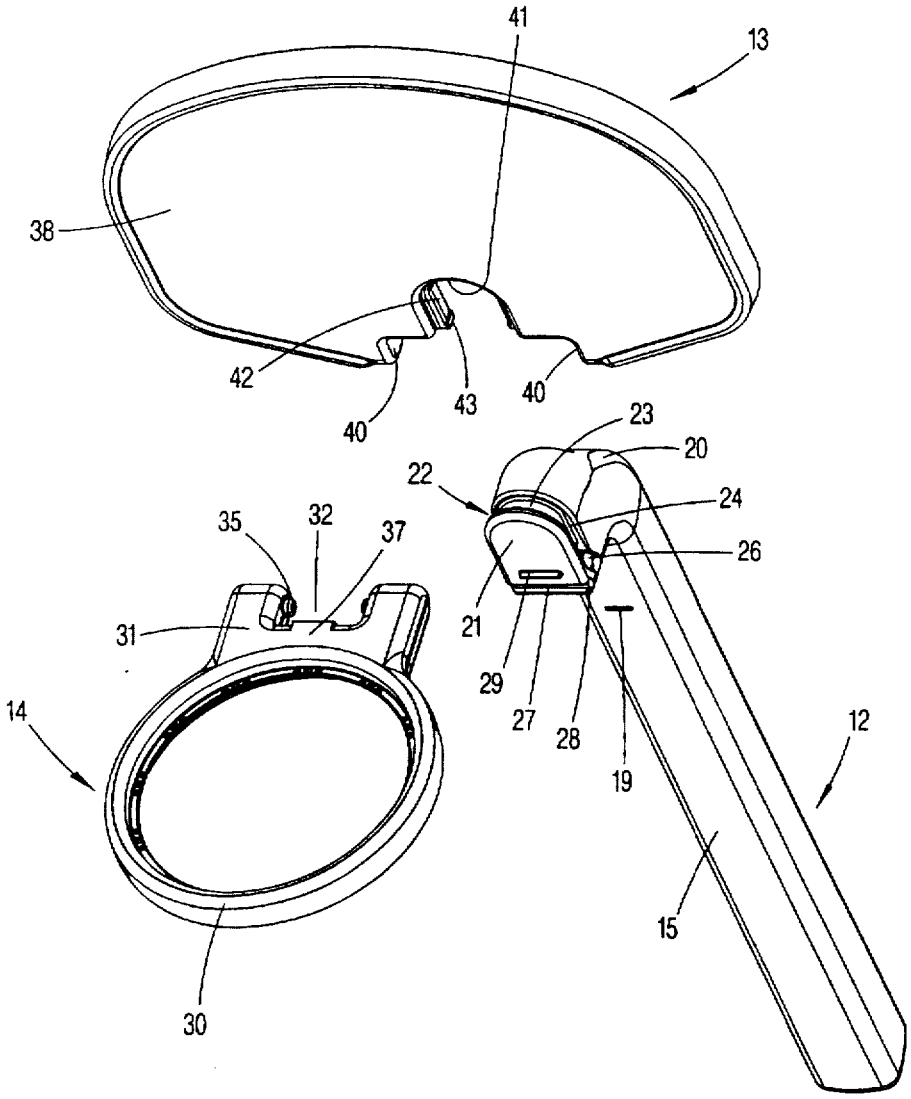
FIG. 3 is an exploded perspective view of the pole, rim and backboard components of the basketball goal shown in FIG. 1.
Figure 4:
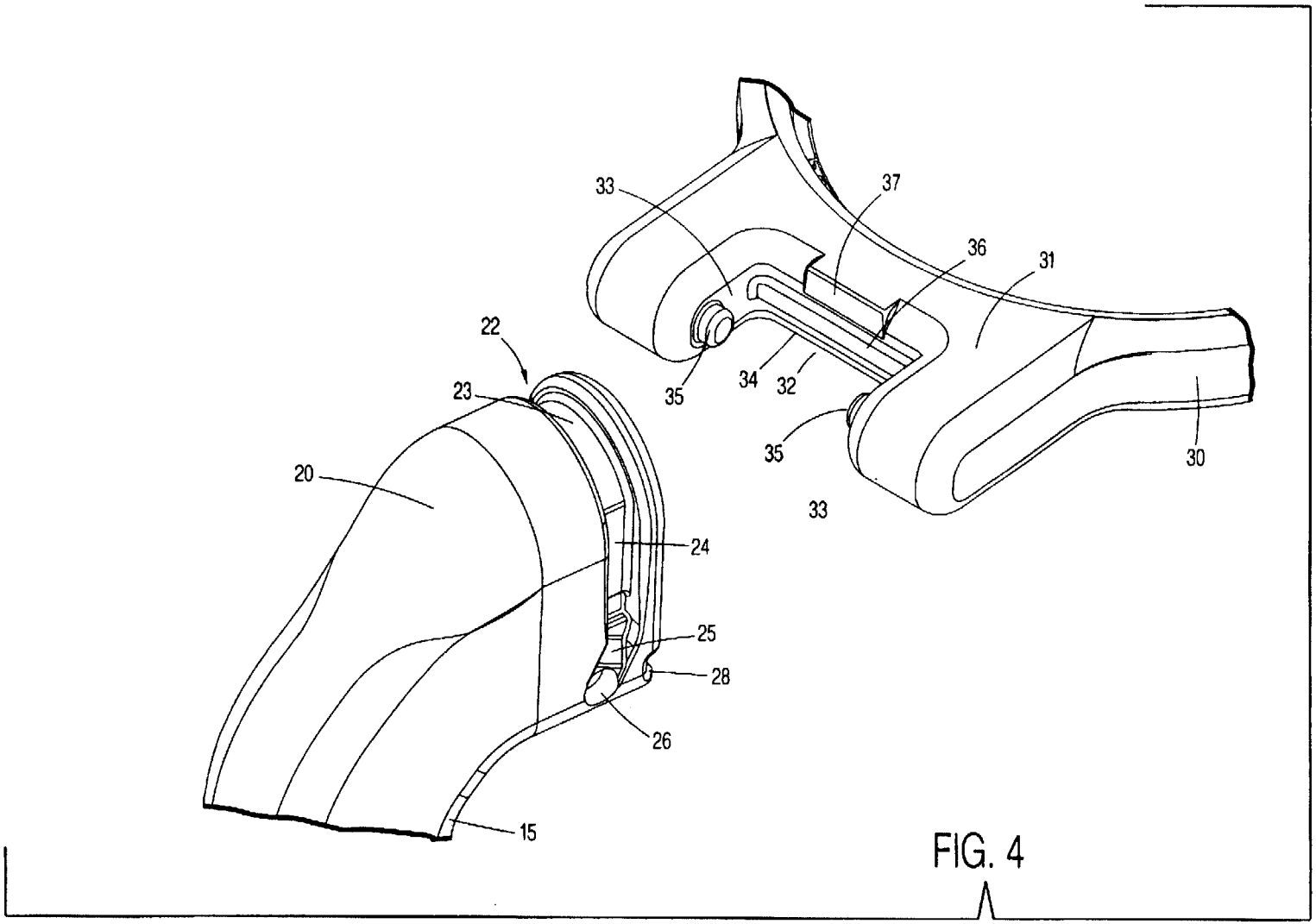
FIG. 4 is a fragmented exploded perspective view of the pole and rim components of the basketball goal shown in FIG. 1.

As best shown in FIGS. 3 and 4, the top of upper pole 15 is formed as an elbow-like portion 20 which terminates as a front vertically oriented face 21. A U-shaped slot, generally indicated by the numeral 22, is formed in elbow portion 20. Slot 22 is configured to include a top arcuate portion 23, generally vertical side surfaces 24, and tapered surfaces 25 leading to sockets 26 formed at the bottom thereof. A recess 27 extends across face 21 near the bottom thereof and, as will hereinafter be described, recess 27 is adapted to engage rim assembly 14. A notch 28 is formed near each end of recess 27 and, as will hereinafter be described, notches 28 are adapted to engage backboard 13. A lug 29 is positioned on face 21 generally above recess 27 which, as will also be hereinafter described, is adapted to prevent rim assembly 14 from being lifted from its normal horizontal position.

Rim assembly 14 includes the typical basketball hoop 30 of a size to accommodate and receive a ball therethrough. For young children, traditionally such balls are significantly smaller than a regulation basketball, and may be of the inflatable type or may even be made of a foam-like material. A net (not shown) may be attached to hoop 30 in a conventional fashion.

Hoop 30 is carried by a rim flange 31 which has a generally U-shaped cutout 32 formed therein, cutout 32 having opposed sidewalls 33 joined by an end wall 34. Opposed generally circular pivot lugs 35 are formed on sidewalls 33, and an elongate lock lug 36 is formed on end wall 34. A stop lug 37 is formed near the top of end wall 34 and above lock lug 36.

Figure 5:
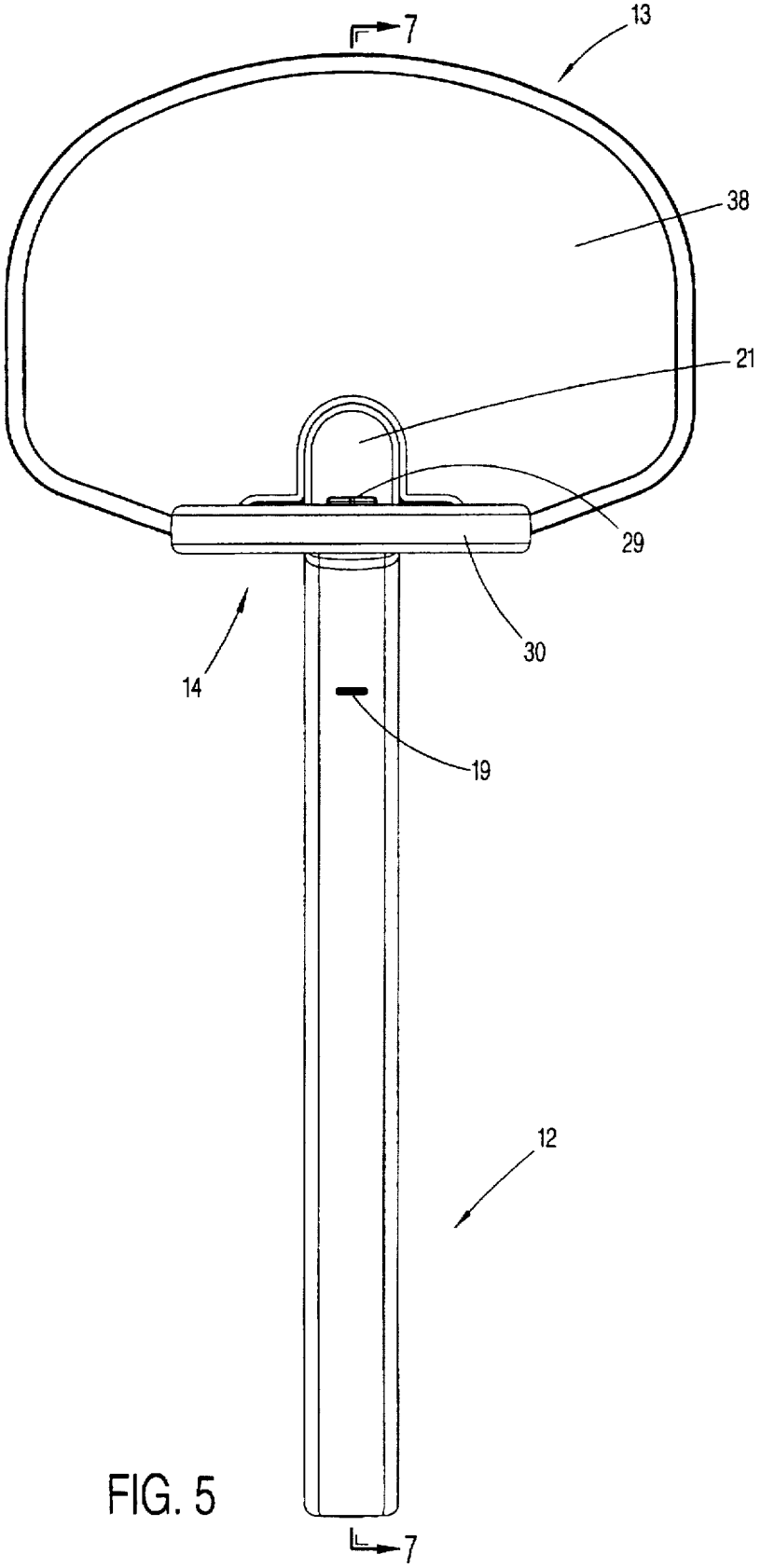
FIG. 5 is a front elevational view of the basketball goal of FIG. 1 showing the rim in its upright, operating position.
Figure 6:
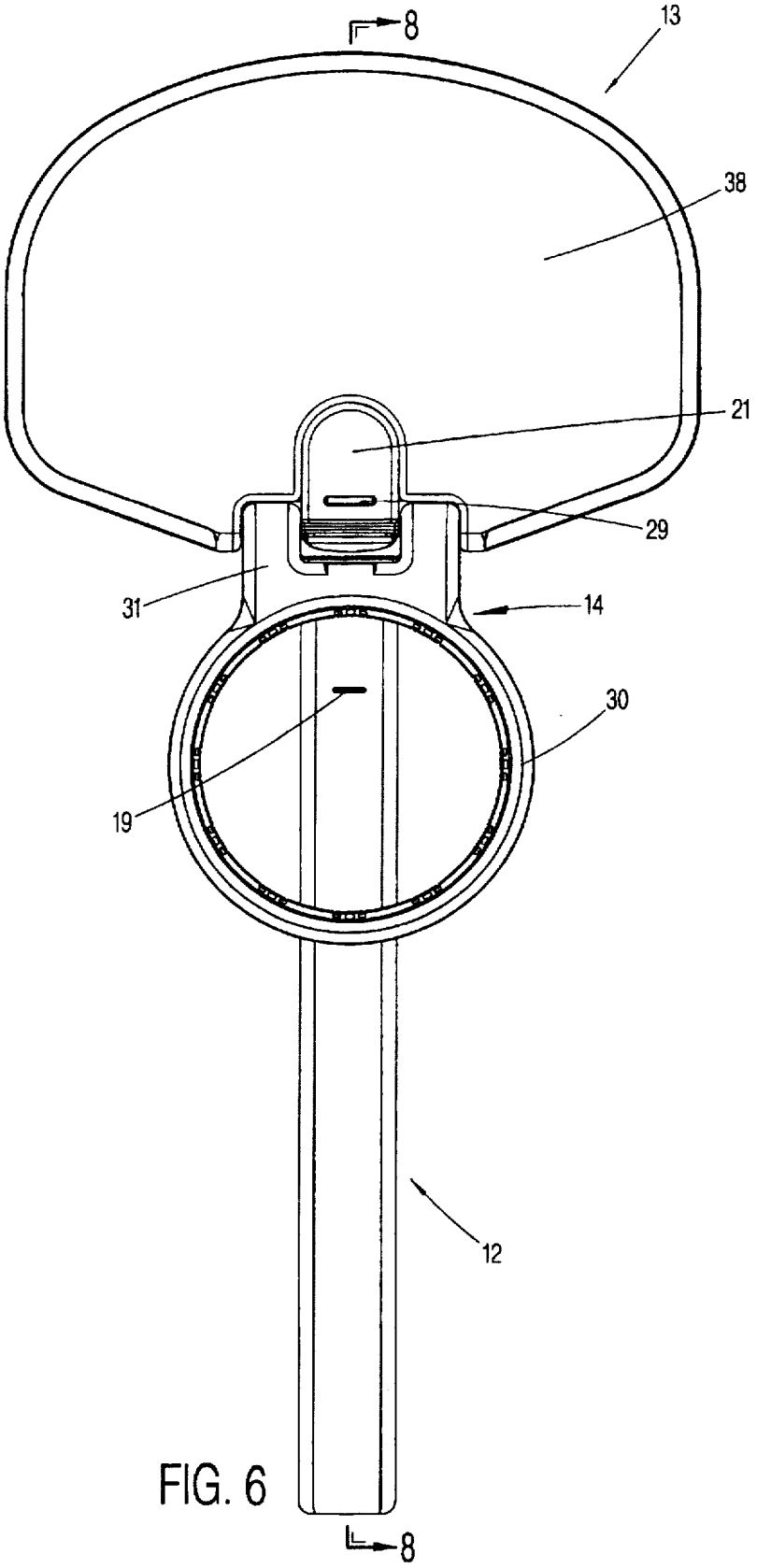
FIG. 6 is a front elevational view of the basketball goal of FIG. 1 showing the rim in its broken away position.
Figure 7:
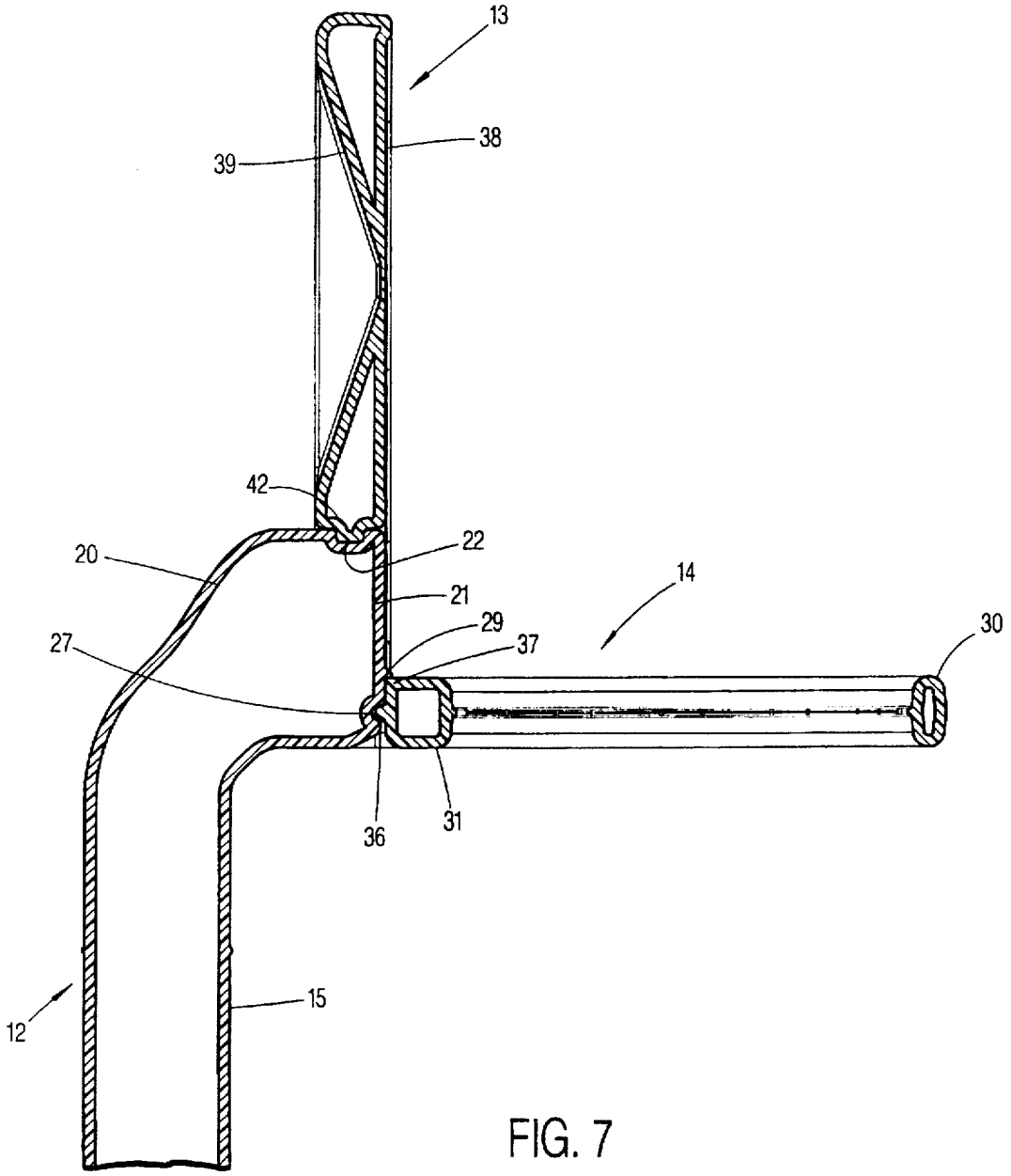
FIG. 7 is a sectional view taken substantially along line 7—7 of FIG. 5.
Figure 8:
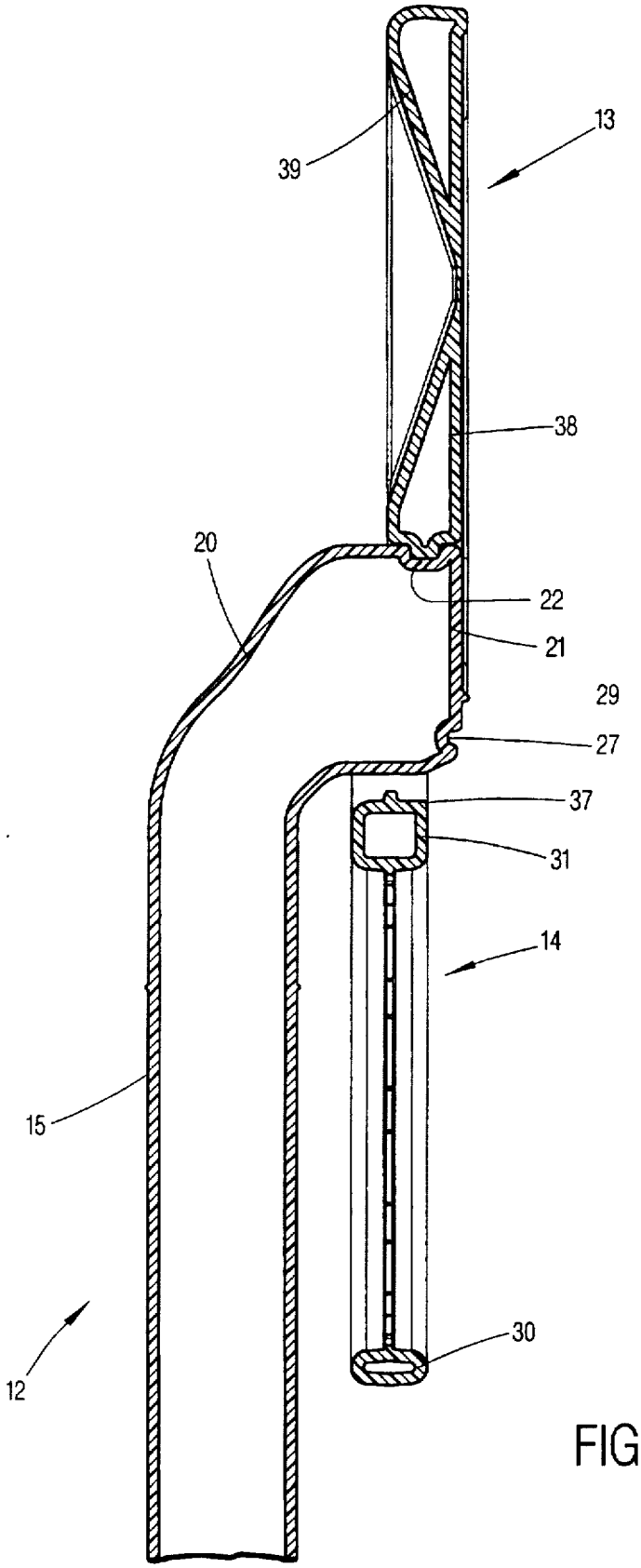
FIG. 8 is a sectional view taken substantially along line 8—8 of FIG. 6.

Rim assembly 14 is connected to upper pole 15 by sliding pivot lugs 35 down surfaces 24 of slot 21. Continued downward movement causes lugs 35 to ride up tapered surface 25 and eventually snap into sockets 26. Rim assembly 14 is thus pivotally attached to pole assembly 12 on an axis defined by lugs 35 and sockets 26. As such, it can be pivoted from one position shown in FIGS. 6 and 8 where rim assembly 14 can be seen to be hanging generally vertically and parallel to pole assembly 12, to a second operating position shown in FIGS. 5 and 7 where rim assembly 14 is horizontally oriented. Rim assembly 14 is normally maintained in the FIG. 8 position because lock lug 36 is received in recess 27 of pole assembly 12. In this position, stop lug 37 bears against lug 29 of pole assembly 12 to prohibit further upward movement of rim assembly 14 past the FIG. 7 position. However, if a downward force is placed on hoop 30, as by a child grabbing it, rim assembly 14 will be released from pole assembly 12 without putting a sufficient tilting force on pole assembly 12 to cause the same to fall.

Backboard 13 is provided with a smooth front face 38 and a rear surface 39 which is somewhat honeycombed in nature to provide strength and to reduce material cost. As best shown in FIG. 3, the bottom edge of backboard 13 is provided with a recess defined by side edges 40. A U-shaped counterrecess 41 is positioned centrally of recess 40. Side rails 42 formed in the edge of counterrecess 41 are provided with opposed lips 43 near the bottom thereof where counterrecess 41 intercepts recess 40.

With rim assembly 14 attached to pole assembly 12 as previously described, backboard 13 may be attached to assemblies 14 and 12 by sliding backboard 13 downwardly onto the assemblies 14 and 12. As such, slot 22 of upper pole 15 receives the side rails 42 of counterrecess 41 and opposed lips 43 snap into notches 28 of upper pole 15. At the same time, recess edges 40 are positioned around rim flange 31 of rim assembly 14, and this portion of goal assembly 10 is connected in place. Of course, disassembly is just as simple and is accomplished by merely reversing the steps.

Goal assembly 10 is provided with a goal scoring system generally indicated by the numeral 44. To that end, lower pole 16 is provided with arcuate side edges 45 each having opposed vertical channels 46 formed therein. A plurality of evenly, vertically spaced protuberances 47 are formed on lower pole 16 adjacent to each channel 46. A clip 48 rides in channels 46 on each side of pole 16 and has outer flaps 49 which snap over, or otherwise engage selected opposed, aligned protuberances 47. As such, a user of goal assembly 10 can keep track of how many goals have been made by sliding clip 48 to the next adjacent protuberance 47 each time a goal is made. In a competition between two users, the position of one clip 48 relative to the position of the other clip 48 may be observed to determine who is winning the competition. Moreover, if desired, numerical indicia may be associated with each protuberance so that an actual numerical score may be observed.

Base pedestal 11 includes a hollow U-shaped periphery, generally indicated by the numeral 50, defined by side walls 51 having a rear wall 52 extending therebetween. Near the junction of rear wall 52 and side walls 51 are apertures 53 which provide access to the interior of hollow periphery 50. Such apertures 53 are provided so that sand or the like can be introduced into hollow periphery 50 to provide stability to goal assembly 10.

Figure 2:
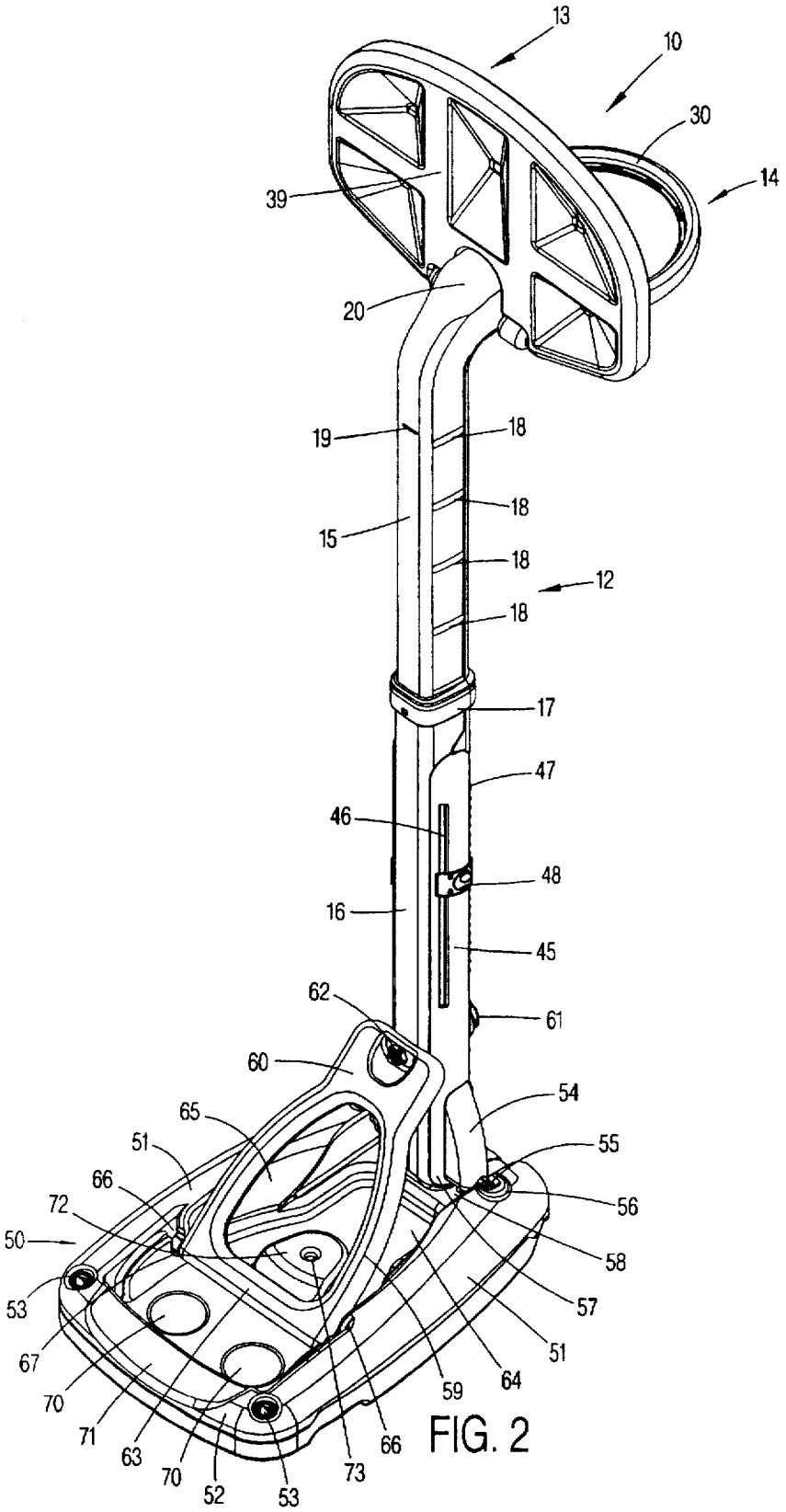
FIG. 2 is a rear perspective view of the basketball goal shown in FIG. 1.

The manner in which lower pole 16 is attached to base pedestal 11 is best shown in FIGS. 1 and 2. The bottom of lower pole 16 is provided with opposed flanges 54, each of which are provided with pins 55 that are received in sockets 56 formed in side walls 51 of the periphery 50 of base pedestal 11. The bottom 57 of pole 16 rests on a ledge 58 formed between side walls 51 such that unless a significant backward force is exerted on lower pole 16, it will stand erect when pins 55 are positioned in sockets 56. However, for total stability, a yoke, generally indicated by the numeral 59, is provided to assure that lower pole 16 is maintained vertically. The upper end 60 of yoke 59 is attached to lower pole 16 by means of a threaded fastener 61 which passes through lower pole 16 and yoke 59 and is attached thereto by a nut 62. The lower end 63 of yoke 59 is received in a compartment 64 formed in base pedestal 11 between walls 51 and 52 of its periphery 50 and ledge 58. The side walls 65 of compartment 64 are provided with opposed slots 66 which are open on top. Pins 67 carried at the lower end 63 of yoke 59 may be snapped into slots 66 to attach yoke 59 to base pedestal 11. Thus, yoke 59 assures that lower pole 16 cannot be rotated relative to base pedestal 11.

Goal assembly 10 may be rendered mobile by positioning wheels 68 (FIG. 1) on an axle 69 extending between the ends of side walls 51 adjacent to the area where lower pole 16 is attached to base pedestal 11. As such, by merely manually tilting goal assembly 10 on its wheels 68, it may be moved about, as desired.

Compartment 64 of base pedestal 11 may be provided with arcuate depressions 70 therein which are adapted to receive and hold the play basketballs when not in use.

Figure 9:
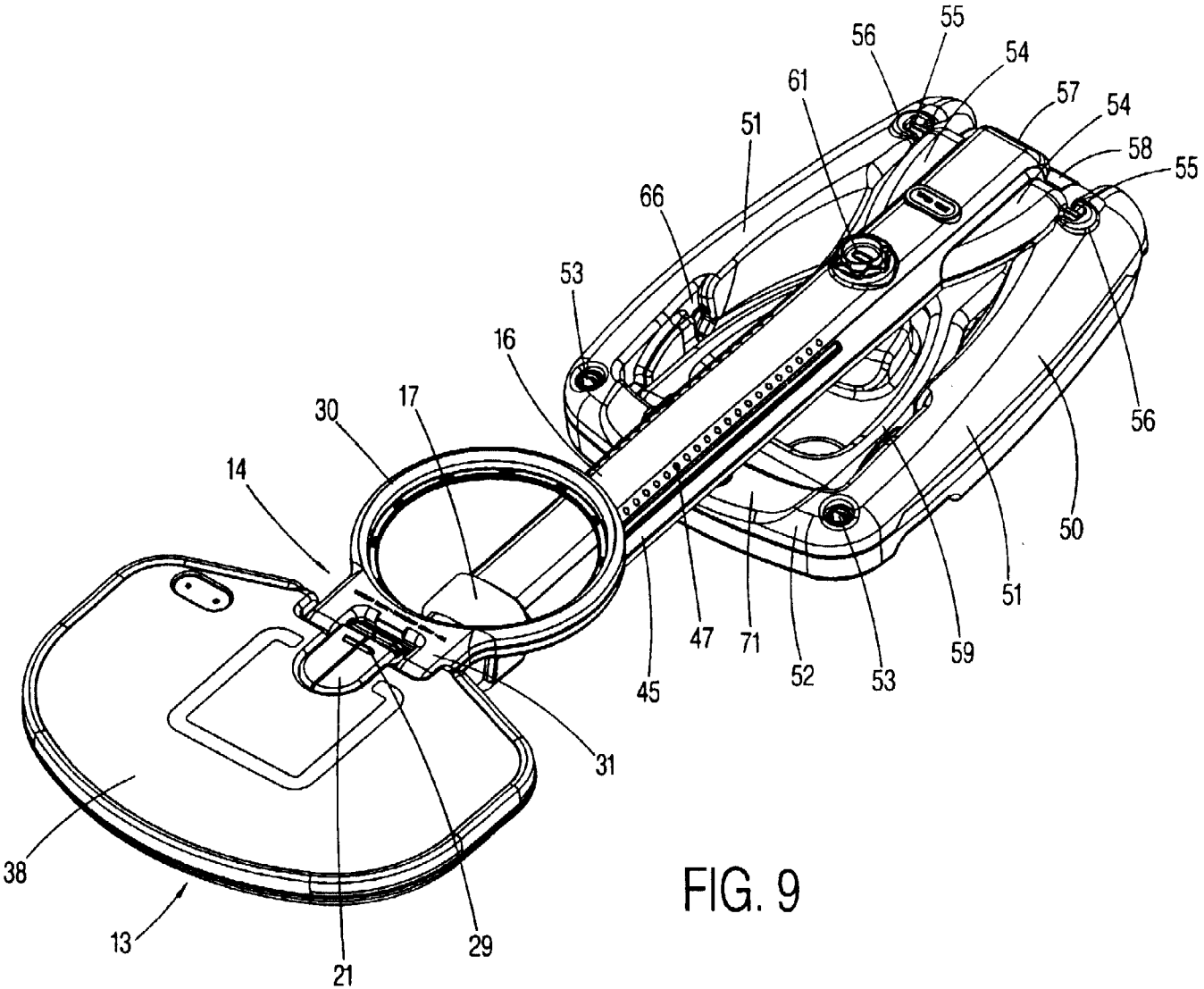
FIG. 9 is a perspective view of the basketball goal of FIG. 1 showing the components thereof in a folded condition for storage or shipment.

Compartment 64 also enables goal assembly 10 to be stored flat, as shown in FIG. 9. Such is accomplished by detaching yoke 59 from lower pole 16 by removing pin 61. The yoke 59 may be snapped out of slots 66 and laid flat in compartment 64, as shown in FIG. 9. In this regard, it should be noted that the profile of compartment 64, as generally viewed in plan, can be generally configured to be the same as the profile of yoke 59 so that yoke 59 is rather snugly confined therein. Then pole assembly 12 may be rotated on its pins 55 to the FIG. 9 position. In this regard, rear wall 52 of periphery 50 of base pedestal 11 may be dished out, as at 71, so that lower pole 16 may rest flat on base pedestal 11. A hub 72 having an aperture 73 therein is formed generally centrally in compartment 64. When lower pole 16 is rotated to the FIG. 9 position, its aperture which receives fastener 61 in the FIGS. 1 and 2 position, is now aligned with aperture 73 of hub 72. As such, fastener 61 may be conveniently used to hold lower pole 16 in the FIG. 9 position by passing it through lower pole 16 and utilizing nut 62 positioned under base pedestal 11 to tighten the components thereby sandwiching yoke 59 between lower pole 16 and base pedestal 11. As also shown in FIG. 9, the flat unit can be made quite compact for storage or shipment by breaking away rim assembly 14, in a manner previously described, and by telescoping upper pole 15 fully into lower pole 16.

It should thus be evident that a basketball goal constructed as described above accomplishes the objects of the present invention and otherwise substantially improves the art.

What is claimed is:

1. A basketball goal comprising a base, a pole assembly carried by said base, a rim assembly pivotally carried by said pole assembly, and a backboard carried by said pole assembly, said pole assembly having a front face with a recess therein, said rim assembly having a lug receivable in said recess such that when said lug is in said recess, said rim assembly is held in a useable condition, but when a downward force is applied to said rim assembly, said lug is released from said recess.

2. A basketball goal according to claim 1 further comprising a slot in said pole assembly to receive said rim assembly and said backboard.

3. A basketball goal according to claim 2 further comprising a socket at each end of said slot, and pivot lugs carried by said rim assembly, said pivot lugs being received in said sockets.

4. A basketball goal according to claim 2 further comprising rails formed on said backboard, said rails being received in said slot.

5. A basketball goal according to claim 4 further comprising notches formed in said front face, and lips formed on said backboard, said lips being received in said notches.

6. A basketball goal according to claim 1 further comprising a stop lug formed on said rim assembly, and a lug on said front face, said stop lug bearing against said lug on said front face to prevent rotation of said rim assembly in one direction.

7. A basketball goal according to claim 1, said pole assembly including an upper pole and a lower pole, one said pole being telescopically received within the other said pole so that the height of the basketball assembly may be adjusted.

8. A basketball goal according to claim 1, wherein said base includes a hollow portion and access openings to said hollow portion so that said hollow portion can be filled with a material to add weight to said base.

9. A basketball goal according to claim 1 further comprising opposed sockets formed in said base, and opposed pins formed on said pole assembly, said pins being received in said sockets.

10. A basketball goal according to claim 9 further comprising a yoke positioned between said pole assembly and said base.

11. A basketball goal according to claim 10 further comprising slots formed in said base, and pins formed on said yoke, said pins being received in said slots.

12. A basketball goal according to claim 10 further comprising a compartment formed in said base, said yoke being positionable in said compartment, said pole assembly being pivotable on said pins to a position over said yoke when said yoke is in said compartment.

13. A basketball goal according to claim 12 further comprising a hub formed in said compartment, said pole assembly being attachable to said hub when said pole assembly is positioned over said yoke.

14. A basketball goal according to claim 1 further comprising a goal scoring system on said pole assembly.

15. A basketball goal according to claim 14 wherein said pole assembly has channels formed therein and said goal scoring system includes a clip moveable in said channels.

16. A basketball goal according to claim 15 wherein said goal scoring system includes regularly spaced protuberances formed on said pole assembly adjacent to a said channel, said clip engaging selected of said protuberances.

17. A basketball goal according to claim 1 further comprising wheels carried by said base such that the basketball goal may be rendered mobile.

18. A basketball goal according to claim 1, said rim assembly including a hoop and a flange carrying said hoop, a cutout in said flange, and pivot lugs formed in said cutout, said pole assembly including an elbow having a slot therein, and sockets formed in said slot, said pivot lugs being received in said sockets.

19. A basketball goal according to claim 18, said backboard having a recess at the bottom thereof, said recess fitting around said flange.

20. A basketball goal according to claim 19, said recess having a counterrecess formed therein, and rails formed in said counterrecess, said rails being received in said slot.

21. A basketball goal according to claim 20 wherein said front face is at the end of said elbow and further comprising notches formed in said front face, and lips formed in said counterrecess to engage said notches.

22. A basketball goal comprising a base, a pole assembly carried by said base, a rim assembly carried by said pole assembly, a backboard carried by said pole assembly, and a yoke extending between said base and said pole assembly, said base having a compartment therein, said yoke being receivable in said compartment and said pole assembly being pivotable to a position over said yoke when said yoke is in said compartment.

23. A basketball goal according to claim 22 further comprising sockets in said base and pins carried by said pole assembly and received in said sockets so that said pole assembly can be pivoted relative to said base.

24. A basketball goal according to claim 22 further comprising slots formed in said compartment and pins carried by said yoke, said pins being receivable in said slots.

25. A basketball goal according to claim 22 wherein the profile of said compartment approximates the profile of said yoke.

26. A basketball goal according to claim 22 further comprising depressions formed in said compartment to receive balls to be used with the goal assembly.

27. A basketball goal according to claim 22 further comprising a hub formed in said compartment, said pole assembly being attachable to said hub when said pole assembly is positioned over said yoke.

28. A basketball goal according to claim 22 further comprising sockets formed in said pole assembly and pivot lugs formed on said rim assembly, said lugs being received in said socket so that said rim assembly may be pivoted with respect to said pole assembly to a position generally parallel to said backboard.

29. A basketball goal according to claim 22 said pole assembly having a front face with a recess therein, said rim assembly having a lug receivable in said recess such that when said lug is in said recess, said rim assembly is held in a useable condition, but when a downward force is applied to the rim assembly, said lug is released from said recess.

30. A basketball goal comprising a base, a pole assembly pivotally carried by said base, a rim assembly pivotally carried by said pole assembly, a backboard carried by said pole assembly, said pole assembly having a front face with a recess therein, said rim assembly having a lug receivable in said recess such that when said lug is in said recess, said rim assembly is held in a useable condition, but when a downward force is applied to the rim assembly, said lug is released from said recess, and a yoke extending between said base and said pole assembly, said base having a compartment therein, said yoke being receivable in said compartment and said pole assembly being pivotable to a position over said yoke when said yoke is in said compartment.

* * * * *